United States Patent [19]

Galea

[11] 3,999,891

[45] Dec. 28, 1976

[54] PUMP USING SPACED SEQUENTIAL DISPLACEMENTS ALONG A FLEXIBLE TUBE

[76] Inventor: Joseph Galea, 22 Greenhaven Drive, Pennant Hills New South Wales, Australia

[22] Filed: May 23, 1975

[21] Appl. No.: 580,168

[30] Foreign Application Priority Data

May 29, 1974 Australia ..... 7704/74

[52] U.S. Cl. ..... 417/53; 417/900; 417/477

[51] Int. Cl.[2] ..... F04B 43/08; F04B 43/12; F04B 45/06

[58] Field of Search ..... 417/474, 475, 476, 477, 417/900, 53; 138/DIG. 1

[56] References Cited

UNITED STATES PATENTS

| | | | |
|---|---|---|---|
| 2,689,530 | 9/1954 | Harvey | 417/474 |
| 2,804,023 | 8/1957 | Lee | 417/477 |
| 2,909,125 | 10/1959 | Daniels | 417/477 |
| 3,105,447 | 10/1963 | Ruppert | 417/475 |
| 3,421,447 | 1/1969 | Jackson et al. | 417/477 |
| 3,433,171 | 3/1969 | Corneil | 417/474 |
| 3,768,934 | 10/1973 | Magerle | 417/477 |

*Primary Examiner*—Carlton R. Croyle
*Assistant Examiner*—Thomas I. Ross
*Attorney, Agent, or Firm*—Dorfman, Herrell and Skillman

[57] ABSTRACT

A method of pumping fluid through a hose by means of progressively sequentially momentarily causing adjacent portions thereof to contract is disclosed. A rotary and a linear pump construction are described.

10 Claims, 6 Drawing Figures

FIG. 1.
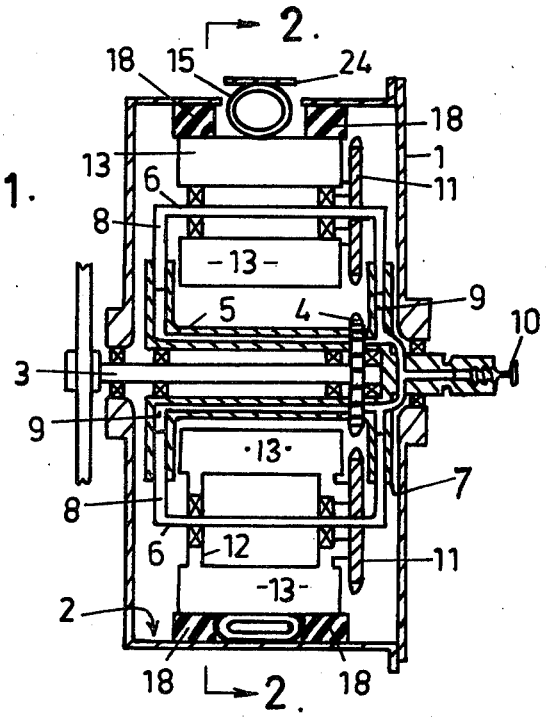
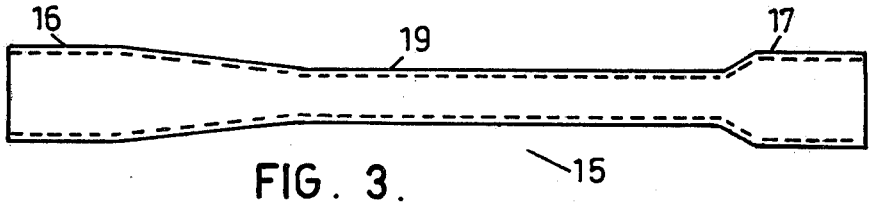
FIG. 3.
FIG. 4.
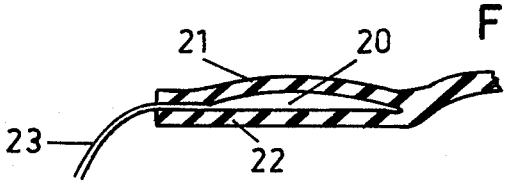

FIG. 2.
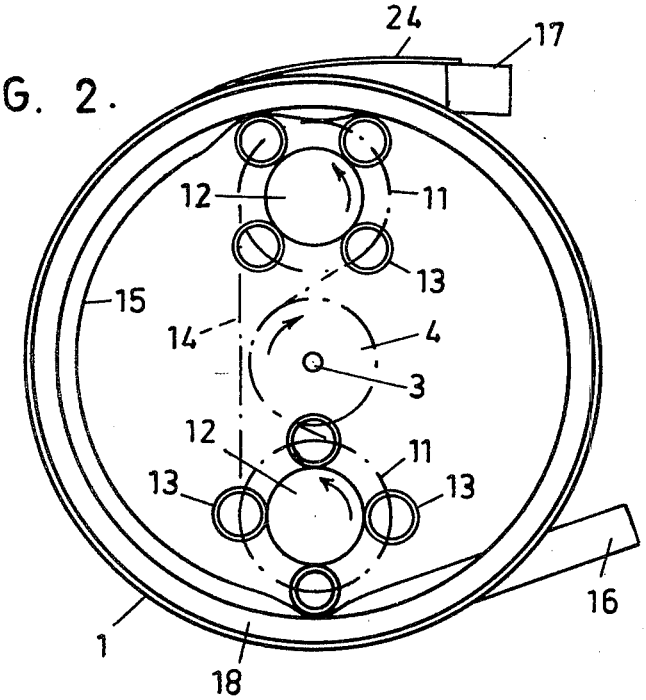
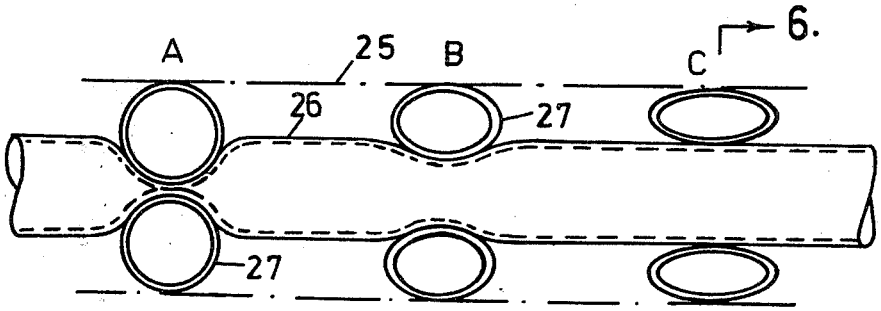
FIG. 5.
FIG. 6.
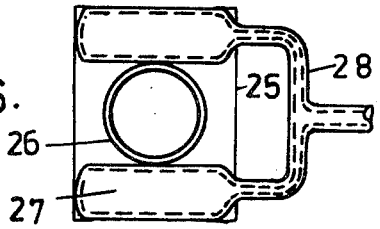

PUMP USING SPACED SEQUENTIAL DISPLACEMENTS ALONG A FLEXIBLE TUBE

The invention relates to fluid pumps and a method of pumping in which the fluid to be pumped does not come into contact with the actual pumping mechanism and in particular its moving parts. This lack of contact is advantageous where the fluid to be pumped is corrosive, an acid for example, or abrasive, liquid concrete for example.

Hitherto pumps and pumping methods of this type have used a flexible hose to isolate the fluid from the pumping mechanism. The fluid has been forced through the hose by roller mechanisms of various types which completely compress the hose with a roller and then roll the roller along the hose to move the compression and hence the hose contents along the hose. This method of pumping and pumps operating by this method suffer from the disadvantage that a large amount of power is required because of the total displacement of the fluid in the hose. The present invention discloses more advantageous pump constructions and a method of pumping.

According to the present invention there is disclosed a method of pumping fluids through a resilient hose wherein adjoining regions of said hose are repeatedly sequentially subjected to momentary compressive forces thereby simultaneously reducing by different degrees the cross-sectional area of said hose at the position of application of said forces to pump fluid through said hose in the direction of sequential maximum cross-sectional area reduction.

In addition there is disclosed a rotary fluid pump comprising a stator having a substantially cylindrical inner surface, a length of resilient hose through which fluid is to be pumped positioned within the stator and abutting said stator inner surface with the ends thereof entending beyond the stator and means rotatable about the longitudinal axis of said stator surface to progressively sequentially momentarily compress adjacent portions of said hose to pump fluid from one (inlet) end of the hose to the other (outlet) end of the hose.

Furthermore this is disclosed a linear fluid pump comprising a resilient hose located within a housing and through which fluid is to be pumped, at least three pairs of opposed inflatable compression members, said hose being interposed between the members of said pairs, said members bearing against support surfaces of the housing and means to inflate and deflate the members of each pair simultaneously, the inflation and deflation means being actuatable to repeatedly sequentially momentarily inflate each of said pairs of members to pump said fluid through said hose in the direction of sequential inflation of said pairs of members.

One embodiment of a rotary and of a linear fluid pump will now be described with reference to the drawings. The method of pumping of the present invention will be apparent from the description of the operation of the pumps.

In the drawings,

FIG. 1 shows a longitudinal cross-section of the preferred embodiment of the rotary fluid pump of the present invention;

FIG. 2 shows a transverse cross-section taken along the line 2—2 of FIG. 1;

FIG. 3 is a longitudinal cross-section of the hose of pump of FIG. 1, the hose being uncompressed and removed from the pump;

FIG. 4 is a partial longitudinal cross-section of the output end of the hose of FIG. 3.

FIG. 5 is a longitudinal cross-section of the preferred embodiment of the linear fluid pump of the present invention; and FIG. 6 is a cross-section taken along the line 6—6 of FIG. 5.

Referring now to FIGS. 1 and 2, the rotary fluid pump of the preferred embodiment comprises a stator 1 having a substantially cylindrical inner surface 2. Rotatably mounted within the stator 1 coincident with the longitudinal axis thereof is a shaft 3 which extends beyond the stator 1 and is able to be rotated by means such as an electric motor (not shown). A first sprocket wheel 4 is fixed to the shaft 3 at one of its ends. A carrier 5 is rotatably mounted on the shaft 3 and hydraulically supports two opposed compressor axles 6 by means of cylinders 7 within which pistons 8 are slidably located. The pistons 8 are integral with the corresponding compressor axle 6. Hydraulic fluid 9 contained within the carrier 5 supports the pistons 8. The radial displacement of the compressor axles 6 from the shaft 3 is adjustable by means of threaded plunger 10, manual rotation of which controls the pressure of hydraulic fluid 9.

Rotatably mounted on each compressor axle 6 and co-planar with the first sprocket wheel 4 is a second sprocket wheel 11. Fixed to each sprocket wheel 11 is a compressor member 12. As seen in FIG. 2 four equally angularly spaced bars 13 are fixed to the compressor member 12 and project equally radially outwardly from the corresponding compressor axles 6.

A drive chain 14 connects the first and second sprocket wheels 4 and 11 such that clockwise rotation of the shaft 3 (as seen in FIG. 2) rotates the compressor members 12 in an anticlockwise direction about their respective compressor axle 6.

A resilient hose 15 has an inlet end 16 and an outlet end 17 and lies against the inner surface 2 of the stator 1 in a half turn between two rings 18 of resilient compressible material. The rings 18 together with the inner surface 2 of the stator 1 provide a track within which the hose 15 is located.

As seen in FIG. 3, the preferred form of the hose 15 has a circular cross-section when the hose 15 is uncompressed, the diameter of the inlet end 16 and the outlet end 17 being substantially the same. The cross-sectional area of the hose 15 gradually decreases from the inlet end 16 to a central portion 19 of substantially constant cross-section and then may rapidly increase between the central portion 19 and outlet end 17. As seen in FIG. 4 the outlet end 17 of the hose 15 preferably has an annular cavity 20 formed between the inner surface 21 and outer surface 22 of the hose 15. The cavity 20 is connected via a tube 23 to a pressure guage (not shown) for measurement of the pressure within the hose 15 at the outlet end 17. Alternatively the tube 23 may connect the cavity 20 to a pulsation damping chamber (not shown) and fluid (such as air, water or oil) within both the cavity 20 and the pulsation damping chamber may then be used to damp fluctuations in internal hose pressure occuring at the output end 17.

In operation the shaft 3 is rotated in a clockwise direction as seen in FIG. 2 and chain 14 rotates each compressor members 12 in an anticlockwise direction about its corresponding compressor axles 6. The rotation of compressor members 12 brings each bar 13, which projects from the periphery of the compressor member 12, into contact with the hose 15 in turn.

As one bar 13 comes into contact with the hose 15 that bar 13 begins to compress the hose 15 whilst the adjacent preceding bar 13 is moving out of contact with the hose 15. As the compressor member 12 continues to rotate the one bar 13 increases the compression of the hose to a maximum compression and then reduces the compression of the hose 15 as that one bar 13 moves out of contact with the hose 15 whilst the next adjacent succeeding bar 13 begins to compress the hose 15 at a position nearer the outlet end 17 of the hose 15.

Because of the frictional engagement between the bars 13 and the hose 15, the carrier 5 is rotated about the shaft 3 thereby moving the compressor members 12 in a clockwise direction about shaft 3 as seen in FIG. 2. Thus each compressor member 12 moves along the hose 15 from the inlet end 16 to the outlet end 17 and continues to rotate until arriving at the inlet end 16 again to complete the cycle.

The bars 13 progressively sequentially momentarily compress adjacent portions of the hose 15 beginning near the inlet end 16 and moving towards the output end 17 to progressively pump the contents of the hose 15 from the inlet end 16 to the outlet end 17 by sequential partial displacement.

The inlet end 16 is tangential to the inner surface 2 of the stator 1 whilst the outlet end 17 preferably lies against an expanding spiral portion 24 of the stator 1. Thus the bars 13 progressively compress the hose 15 to a lesser degree in the vicinity of the outlet end 17. The portion of reducing cross-section of the hose 15 between the inlet end 16 and the central portion 19 displaces a larger amount of material when compressed by bars 13 than is displaced by compression of the central portion 19. This greater displacement compensates for the tendency of the pumped fluid to return to the hose at the outlet end 17 as the bars 13 leave the hose 15 adjacent the outlet end 17. In addition the initial greater displacement ensures that the uncompressed central portion 19 is quickly filled with fluid and therefore operates more effectively.

The pumping action of the pump of the above described preferred embodiment offers several advantages in that heavy slurries are effectively mixed whilst passing through the pump and there is no tendency for the constituents of the slurry to separate. In addition in order to clean the pump a sponge may be pumped through the hose and therefore there is no need to relieve high pressure fluid at the output by means of a valve.

Where viscous liquids are being pumped, for example, it may be desirable to increase the effective resilience of the hose in the vicinity of the inlet. This may be done by the provision of an annular cavity in the hose, similar to cavity 20, adjacent to the inlet. Such a cavity is connected to a source of pressurized fluid and therefore the tendency of the hose to return to its natural shape after compression is increased.

The degree of compression of the hose 15 by the bars 13 may be varied to suit the particular pumping application by adjusting the radial displacement of the compressor axles 6 from the shaft 3 by increasing the pressure of the hydraulic fluid 9. This is achieved by manually turning treaded plunger 10 so as to reduce the volume available to the hydraulic fluid 9.

An embodiment of the linear pump of the present invention will now be described with reference to FIGS. 5 and 6 of the drawings.

The pump comprises a rigid tubular housing 25 within which a resilient hose 26 of substantially constant circular cross-section is positioned between three pairs of cylindrical inflatable compression members 27. Each pair of compression members 27 is connected via conduits 28 to a separate source of hydraulic fluid and means (both not shown) of cyclically increasing and decreasing the pressure of the hydraulic fluid. For example such means may comprise a reciprocating piston moving in a cylinder which contains the hydraulic fluid.

The pairs of compression members 27 therefore undergo a cylical inflation and deflation to respectively compress the hose 26 and allow the resilient hose 26 to return its natural shape. The cycle for each pair of compression members is so timed that the hose 26 is progressively sequentially momentarily compressed.

Thus as seen in FIG. 5 pair A of the compression members 27 compresses hose 26 to a maximum extent whilst pair B is increasing the compression it creates in the hose 26 and pair C does not compress the hose 26 at all. Then pair A reduces the degree of compression whilst pair B reaches a maximum and pair C begins to compress the hose 26. Next pair A does not compress the hose 26 whilst pair B is reducing its degree of compression and pair C reaches a maximum. Finally pair A increases its degree of compression, whilst pair B does not compress the hose 26 and pair C is reducing its degree of compression.

Then the entire procedure is repeated. Thus the hose 26 is repeatedly subjected to a progressive sequential momentary compression thereby continually pumping fluid within the hose 26 from left to right as seen in FIG. 5.

The foregoing describes only some embodiments of the present invention and modifications, obvious to those skilled in the art, may be made thereto without departing from the scope of the present invention.

For example a greater length of hose 15 may be wound in the form a helix with the stator 1. Similarly different numbers of compressor members 12 and bars 13 per compressor member 12 may be used.

Furthermore additional sections of the abovedescribed linear pump may be placed end to end if desired to provide a multi-stage linear pump.

I claim:

1. A rotary fluid pump comprising a stator having a substantially cylindrical inner surface; a length of resilient hose through which fluid is to be pumped positioned within the stator and abutting said stator inner surface with the ends thereof extending beyond the stator; a plurality of compressor axles mounted parallel to, and for revolution about, the longitudinal axis of said stator surface; a compressor member rotatably mounted on each said compressor axle; and drive means to rotate the compressor members about their respective compressor axles; each said compressor member having a plurality of peripheral projections which sequentially come into contact with and compress said hose against said stator inner surface on rotation of the compressor member about its corresponding compressor axle, whereby the sequential engagement of said peripheral projections with said hose by said drive means revolves said compressor axles about the longitudinal stator axis in a direction opposite to the direction of rotation of said compressor members, and said compressor members undergo retrograde planetary motion about said longitudinal stator axis.

2. The pump as claimed in claim 1 wherein said drive means comprises a shaft rotatably mounted within said stator co-incident with said longitudinal axis and extending beyond said stator, a carrier rotatably mounted on said shaft and having said compressor axles rotatably secured thereto, said shaft having a first sprocket wheel fixed thereto, each compressor member having a second sprocket wheel secured thereto and co-planar with said first sprocket wheel, and chain means interconnecting said sprocket wheels.

3. The pump as claimed in claim 1 wherein the radial displacement of said compressor axles from said longitudinal stator axis is variable to vary the degree of compression of said hose by said peripheral projections.

4. The pump as claimed in claim 1 wherein said hose at the inlet end is tangential to said stator inner surface and said hose at the outlet end lies against an expanding spiral portion of said stator inner surface.

5. The rotary pump as claimed in claim 1 wherein said hose when uncompressed has a circular cross-section, the diameter of said hose at said inlet end and said outlet end being substantially equal, said hose having a central portion of constant reduced diameter, the cross-section of said hose gradually decreasing between said inlet end and said central portion and rapidly increasing between said central portion and said outlet end.

6. A rotary fluid pump comprising a stator having a substantially cylindrical inner surface; a length of resilient hose through which fluid is to be pumped positioned within the stator and abutting said stator inner surface with the ends thereof extending beyond the stator; a shaft rotatably mounted within said stator co-incident with the longitudinal stator axis and extending beyond said stator; means to rotate said shaft; a first sprocket wheel fixed to said shaft; a carrier rotatably mounted on said shaft and having a plurality of compressor axles mounted thereon parallel to said longitudinal shaft axis; a compressor member rotatably mounted on each said compressor axle and having a second sprocket wheel secured thereto and co-planar with said first sprocket wheel; and chain means interconnecting said sprocket wheels; wherein each said compressor member has a plurality of peripheral projections which sequentially come into contact with and compress said hose at positions spaced apart along the length of said hose on rotation of the compressor member about its corresponding compressor axle; whereby on rotation of said shaft, said chain means and said sprocket wheels produce rotation of said compressor members about their respective compressor axles and the sequential engagement of said peripheral projections with said hose revolves said carrier and compressor axles about said shaft.

7. The pump as claimed in claim 6 wherein the radial displacement of said compressor axles from said carrier is adjustable to vary the degree of compression of said hose at said positions by said peripheral projections.

8. The pump as claimed in claim 6 wherein said hose at the inlet end thereof is tangential to said stator inner surface and the outlet end of said hose lies against an expanding spiral portion of said stator inner surface.

9. The pump as claimed in claim 6 wherein said hose has an uncompressed circular interior cross-section, the diameter of the uncompressed hose is substantially equal at the ends thereof and at a central portion is of constant reduced diameter, the interior cross-sectional area of said hose gradually decreasing between the inlet end of the hose and the central portion and the interior cross-section of said hose rapidly increasing between said central portion and the outlet end of the hose.

10. A method of pumping fluids through a resilient hose disposed within a stator having a substantially cylindrical inner surface wherein adjoining regions of said hose are repeatedly sequentially subjected to momentary compressive forces at a single position in each of said regions thereby simultaneously reducing by different degrees the cross-sectional area of said hose at said position of application of said force to pump fluid through said hose in the direction of sequential maximum cross-sectional area reduction, said reduction of the cross-sectional area being a maximum in each region at said position of application of force and being a minimum at the ends of said region, said reduction being effected by rotating a compressor member having peripheral projections spaced apart by a distance corresponding to the spacing between said positions in adjoining regions, around said stator inner surface.

* * * * *